US005970660A

United States Patent [19]

Jacobs

[11] Patent Number: 5,970,660

[45] Date of Patent: Oct. 26, 1999

[54] SWING DOOR PIVOT ASSEMBLY

[75] Inventor: Kenneth Jacobs, Surrey, United Kingdom

[73] Assignee: The Stanley Works, New Britain, Conn.

[21] Appl. No.: 09/064,256

[22] Filed: Apr. 22, 1998

[30] Foreign Application Priority Data

Apr. 30, 1997 [GB] United Kingdom ..... 9708867

[51] Int. Cl.[6] ..... E05D 13/00

[52] U.S. Cl. ..... 49/425; 49/382; 16/245

[58] Field of Search ..... 49/425, 382, 381, 49/397; 16/236, 237, 235, 244, 245, 378, 379; 248/221.11, 213.1

[56] References Cited

U.S. PATENT DOCUMENTS

| | | | |
|---|---|---|---|
| 3,584,332 | 6/1971 | Taylor | 16/245 |
| 4,644,992 | 2/1987 | Jerila . | |
| 5,483,770 | 1/1996 | Marinoni | 16/245 X |
| 5,568,673 | 10/1996 | Ryczek . | |
| 5,673,516 | 10/1997 | Hughes et al. | 49/425 |

FOREIGN PATENT DOCUMENTS

0503442 A1 9/1992 European Pat. Off. .

*Primary Examiner*—David M. Purol
*Assistant Examiner*—Hugh B. Thompson
*Attorney, Agent, or Firm*—Pepe & Hazard LLP

[57] ABSTRACT

A pivotable door assembly has stiles and rails which are coupled by brackets having side walls defining a channel opening at the outer ends thereof. Pivot inserts are seated in the brackets on one side of said door and include a body member slidably seated in the channel and a pivot member rotatably seated in the body portion and extending outwardly of said open outer end of said bracket for engagement with the floor and ceiling. The pivot inserts include adjustable fasteners seated in the body member and cooperating with the bracket for adjusting the position of said pivot insert along the length of said channel and thereby the length of the pivot member extending outwardly of the bracket. The body member is comprised of a base element and a movable element which seats the pivot member and is horizontally adjustable. A cover is desirably snap fit over the brackets.

21 Claims, 8 Drawing Sheets

SWING DOOR PIVOT ASSEMBLY

BACKGROUND OF THE INVENTION

The present invention pertains to pivot assemblies for pivotably mounting doors, and, more particularly, to such assemblies which may be inserted into brackets in previously assembled doors.

Sliding doors and pivotable doors often utilize similar door constructions. Some doors such as mirrored doors are comprised of stiles and rails in which are seated mirror panels, and corner brackets are frequently used to join the stiles and rails as well as to mount the hardware to provide pivotal or sliding motion. Often, the appropriate mounting hardware for such motion is provided on the door when it is initially assembled.

Often the door is installed by the user in the so called "do-it-yourself" market. Products in this market must be simple to install by use of commonly available tools. One way in which the door installation may be simplified is to sell the mirror door panels with the hardware already installed. This approach necessitates a duplication of the retail inventory as each style of door panel must be available with the hardware for installation as either a sliding door or a pivotable door. Further, any hardware which projects from the door frame is susceptible to damage during shipment and handling of the panels and increases the cost of packaging and shipment.

Accordingly, it is an object of the present invention to provide a novel pivotable door assembly comprising a door panel with hardware which may be attached at the worksite.

It is also an object to provide such a door assembly which is specifically adapted for home owner installation.

Another object is to provide such a door assembly in which the position of the pivot member may be adjusted horizontally of the door to accommodate door openings which are not perfectly square.

Yet another object is to provide a bracket assembly which secures stiles and rails to provide such a door assembly.

A further object is to provide such a bracket assembly which can be fabricated readily and relatively economically.

A still further object is to provide such a market assembly which includes a universal bracket for all corners of the door and mounting inserts which are interchangeable for mounting along either side of the door.

SUMMARY OF THE INVENTION

It has now been found that the foregoing and related objects may be readily attained in a pivotable door assembly comprising a generally rectangular door having stiles and rails, brackets coupling the ends of the stiles to the adjacent ends of the rails, the brackets having side walls defining a channel extending parallel to the stiles and opening at the outer ends thereof. A pivot insert is seated in each of the pair of the brackets along one side of the door, and it includes a body member slidably seated in the channel and a pivot member rotatably seated in the body portion and extending outwardly of the open outer end of the bracket for engagement with the floor and ceiling respectively. At least one of the pivot inserts includes adjustable means seated in the body member and cooperating with the bracket for adjusting the position of the pivot insert along the length of the channel and thereby the length of the pivot member extending beyond the open outer end of the bracket.

The body member is comprised of a base element and a movable element mounted thereon and movable relative to the base element in a direction perpendicular to the side walls of the bracket. Also included is means for adjustably positioning the movable element relative to the base element and thereby between the sidewalls of the bracket to effect adjustment thereof. Desirably, the positioning means includes a toothed surface portion on the base element extending perpendicularly to the bracket side walls, the toothed surface portion being engageable by a rotatable member disposed in the movable element to move the movable element along the toothed surface portion.

Preferably, the movable element includes a flange portion extending longitudinally over the toothed surface portion, and the flange portion has an aperture therein providing access to the toothed surface portion. A tool may be inserted into the aperture to engage both the toothed surface portion and the flange so that rotation of the tool causes the movement of the movable element relative to the base element. The body member includes releasable fastening means securing the movable element in an adjusted position.

Generally, there are interengaging means on the bracket and pivot insert for preventing unintended separation of the pivot insert from the bracket in which it is seated. Also included is a cover extending over and disengageably mounted on the bracket.

Preferably, the pivot member includes a threaded fastener with a head and a shank extending outwardly of the bracket, and a bushing extending about the shank adjacent the head. The body member has a recess in which the fastener and bushing are seated. The bushing has an enlarged collar spaced from the head of the fastener and the collar bears upon the body member about the recess. The head of the fastener rotatably seats upon the surface of the pivot member at the bottom of the recess.

Desirably, the means for adjusting the position of the pivot insert along the length of the channel comprises a screw threadably seated in the body member and having a head bearing on the bracket. The screw is rotatable to displace the pivot insert in the bracket channel. Usually, the bracket has an end wall against which the screw head bears, and the end wall has an aperture of lesser dimension than the screw head for insertion therethrough of a tool to engage the head to effect rotation of the screw.

DETAILED DESCRIPTION OF THE ILLUSTRATED EMBODIMENT

Figure 1:
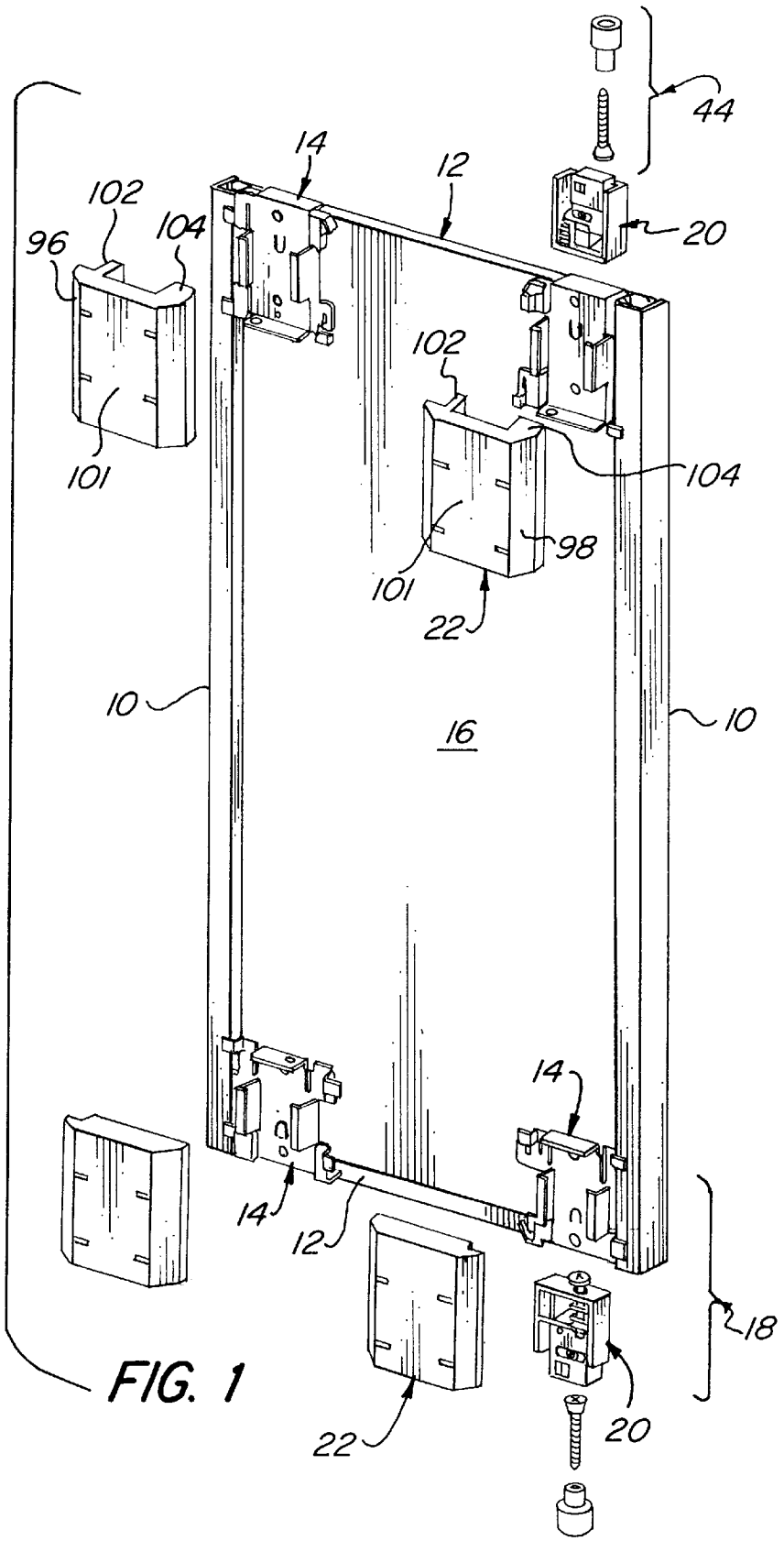
FIG. 1 is a partially exploded view of a pivotable door assembly embodying the present invention.

Turning first to FIG. 1 of the attached drawings, therein illustrated is a door assembly embodying the present invention which is generally comprised of a pair of stiles 10, a pair of rails 12, and corner brackets generally designated by the numeral 14 which secure the rails and stiles in assembly. Seated in channels (not shown) formed in the rails 12 and stiles 10 is a door panel 16 which may be a mirror or other decorative panel such as a composite panel. The bracket assembly is generally designated by the numeral 18 (seen in FIG. 2) is in itself generally comprised of a metal bracket generally designated by the numeral 14 and a pivot insert generally designated by the numeral 20 which is slidably seated within the metal bracket 14. Extending over the bracket 14 and pivot insert 20 is a cover or cap generally designated by the numeral 22.

Figure 3:
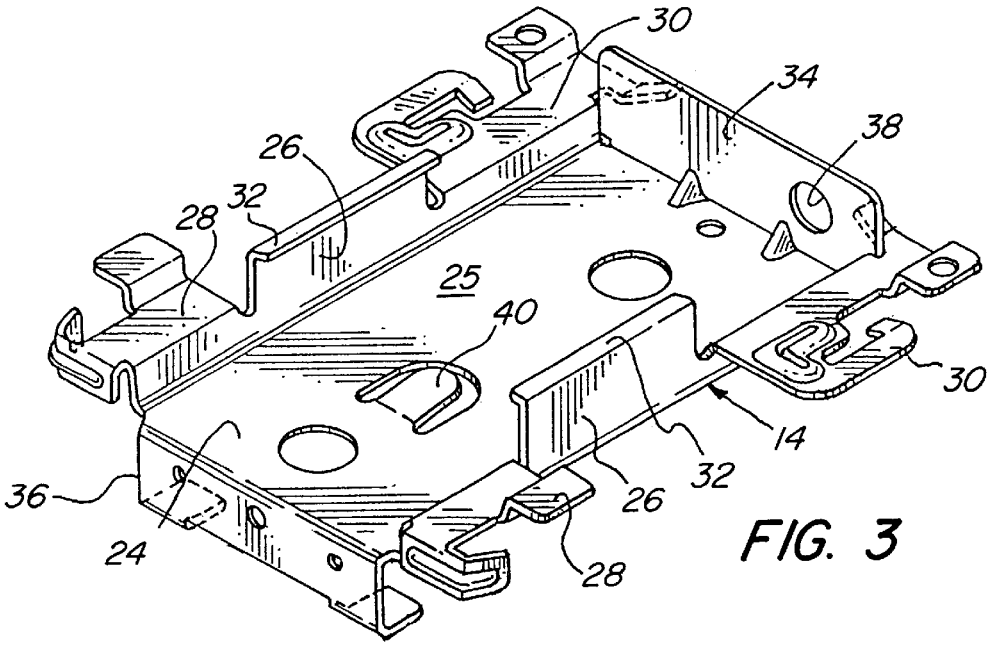
FIG. 3 is a perspective view of the metal bracket drawn to an enlarged scale.

Turning first in detail to the metal bracket 14 as seen in FIG. 3, it has a generally planar body portion 24 having an inner surface 25 upon which the pivot insert 20 is slidable. Along the sides thereof are sidewalls 26 having outwardly extending flanges 28 and 30 at the ends thereof and an inwardly extending lip 32 centrally thereof. The sidewalls 26 and the body portion 24 define a channel in which the pivot insert 20 is slidably seated, and the lips 32 retain the pivot insert 20 therewithin. An end wall 34 extends perpendicularly to the body portion 24 at the inner end thereof between the sidewalls 26 so as to close the channel at its inner end. A flange 36 extends perpendicularly to the outer end of the body portion 24. As is known, the flanges 28, 30 will engage in suitable apertures (not shown) in the stiles 10 and the flange 36 will engage with the rails 12 so as to effect assembly thereof.

The end wall 34 has an aperture 38 therein for a purpose to be described more fully hereinafter. The body portion 24 has an upstanding tab 40 for a purpose which will also be described hereinafter.

Figure 2:
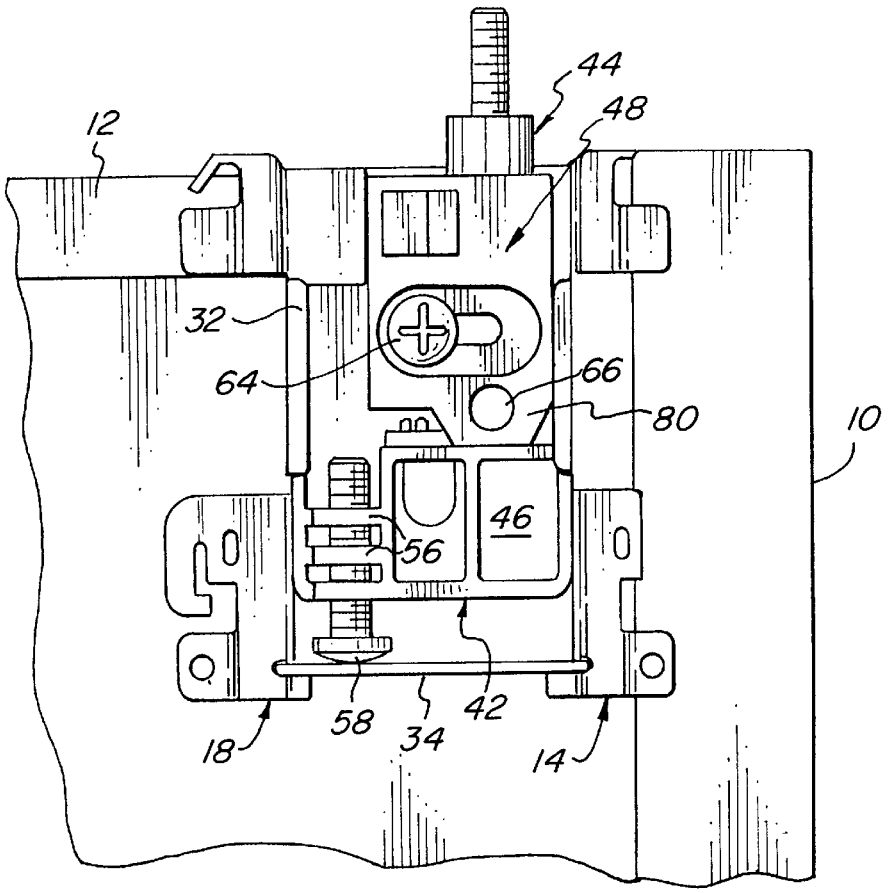
FIG. 2 is a fragmentary rear elevational view of the door drawn to an enlarged scale showing the upper bracket assembly.

As seen in FIG. 2, the pivot insert 20 is comprised of a pivot block generally designated by the numeral 42 and a pivot member generally designated by the numeral 44. The pivot block or body member 42 is, in turn, comprised of a base element generally designated by the numeral 46 and a movable element generally designated by the numeral 48 which are secured in assembly by the fastener 64.

Figure 4:
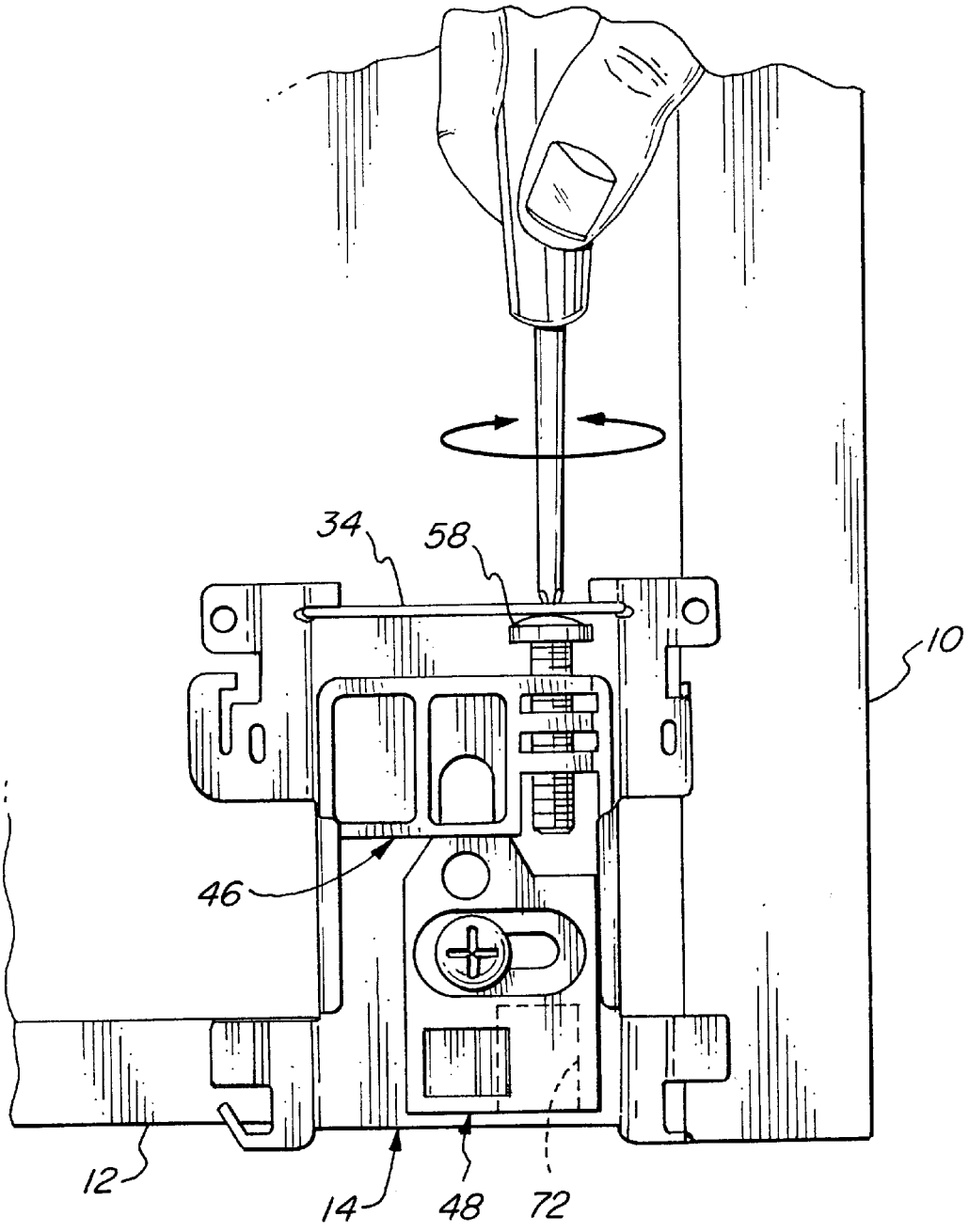
FIG. 4 is a fragmentary rear elevational view of a lower portion of the door drawn to an enlarged scale showing the bottom bracket assembly without the pivot member and showing a screwdriver engaged with the vertical adjustment screw.
Figure 5:
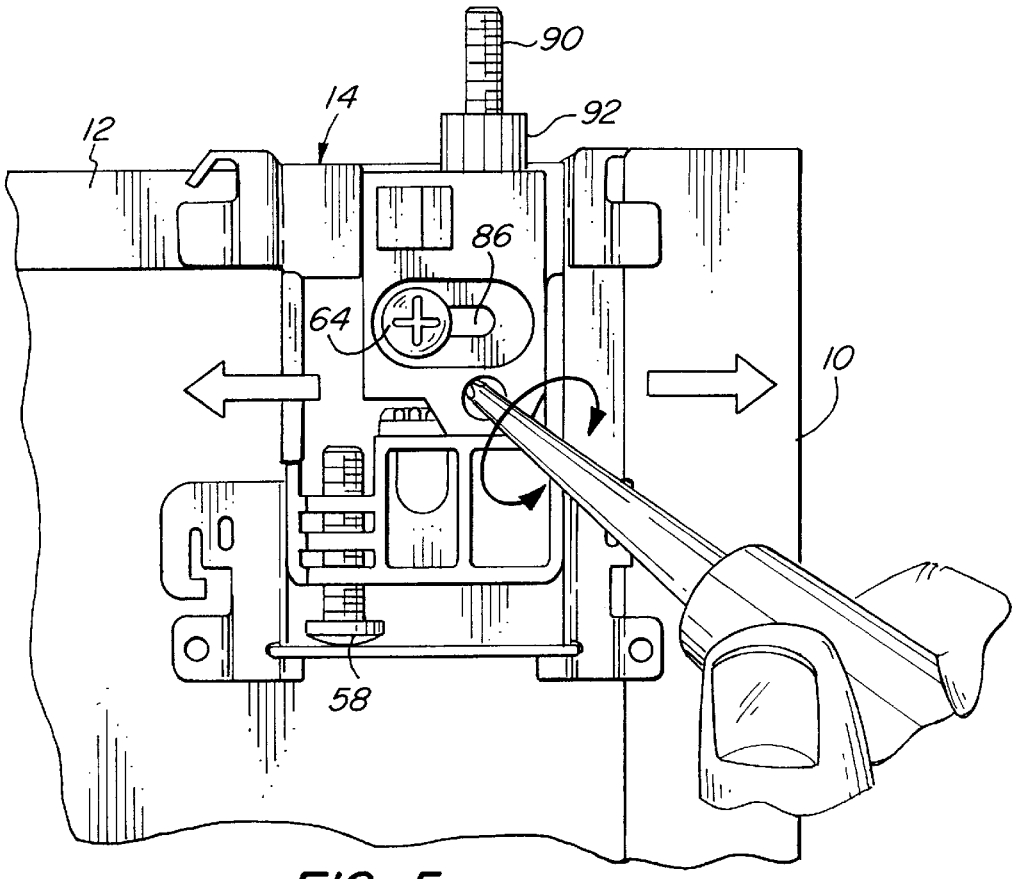
FIG. 5 is a fragmentary rear elevational view of a portion of the door showing the top bracket assembly with a tool engaged to effect horizontal adjustment.
Figure 6:
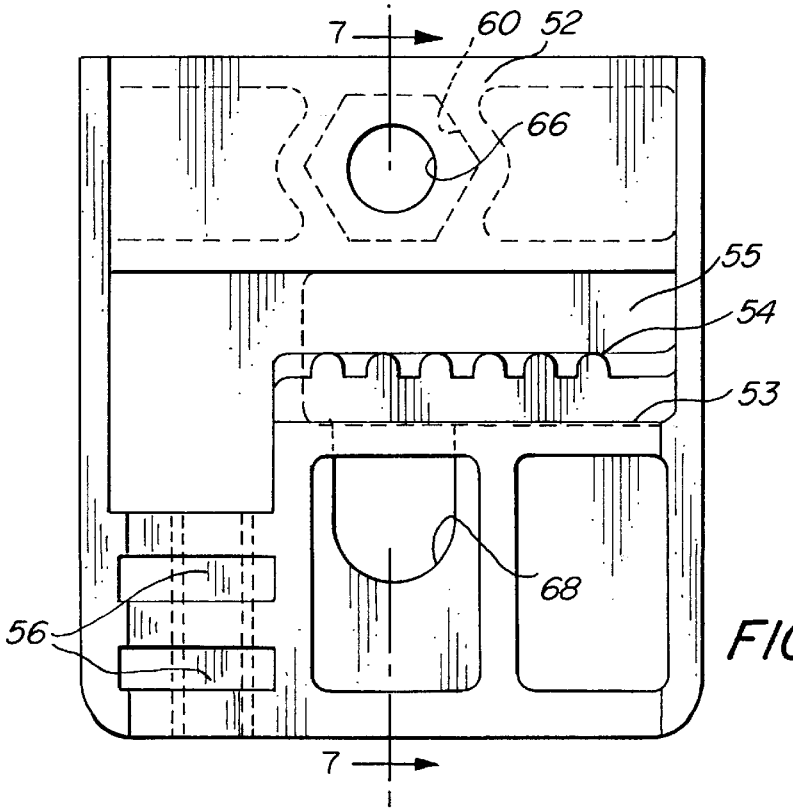
FIG. 6 is an front elevational view of the base element of the pivot block of the top bracket assembly drawn to an enlarged scale.
Figure 7:
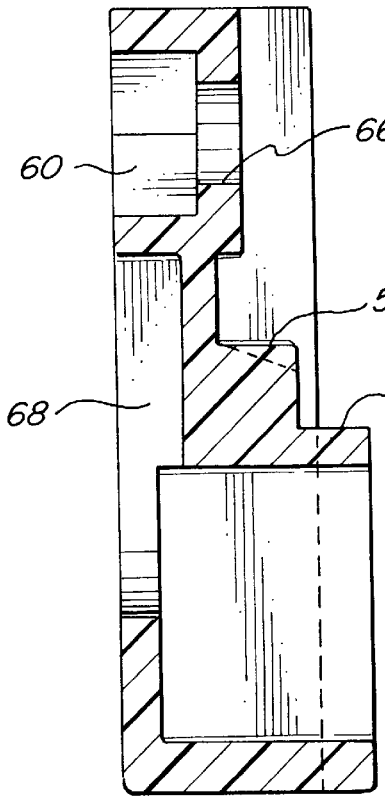
FIG. 7 is a sectional view thereof along the line 7—7 of FIG. 6.
Figure 8:
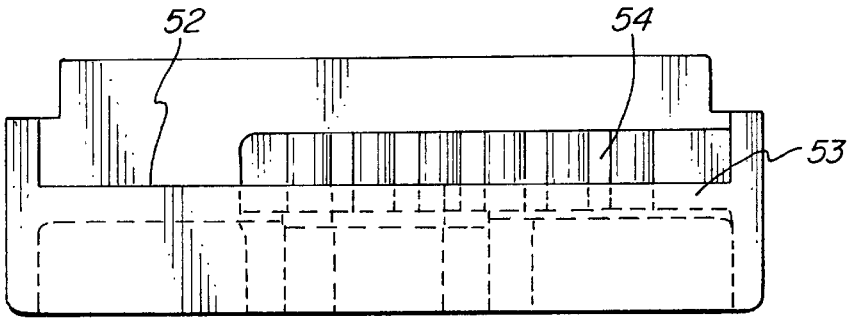
FIG. 8 is a top view thereof.
Figure 9:
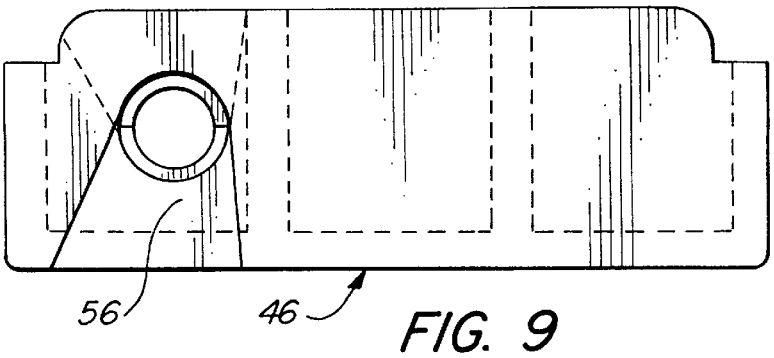
FIG. 9 is a bottom view thereof.
Figure 11:
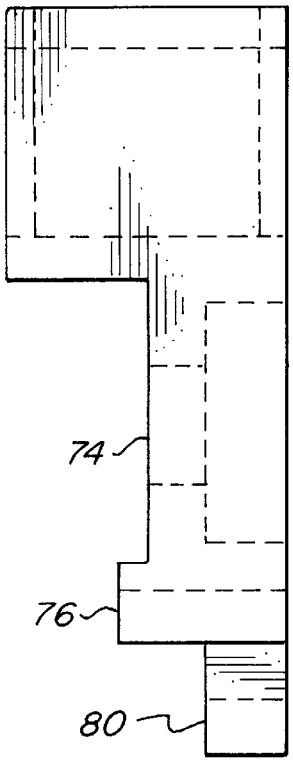
FIG. 11 is a side elevational view thereof.
Figure 10:
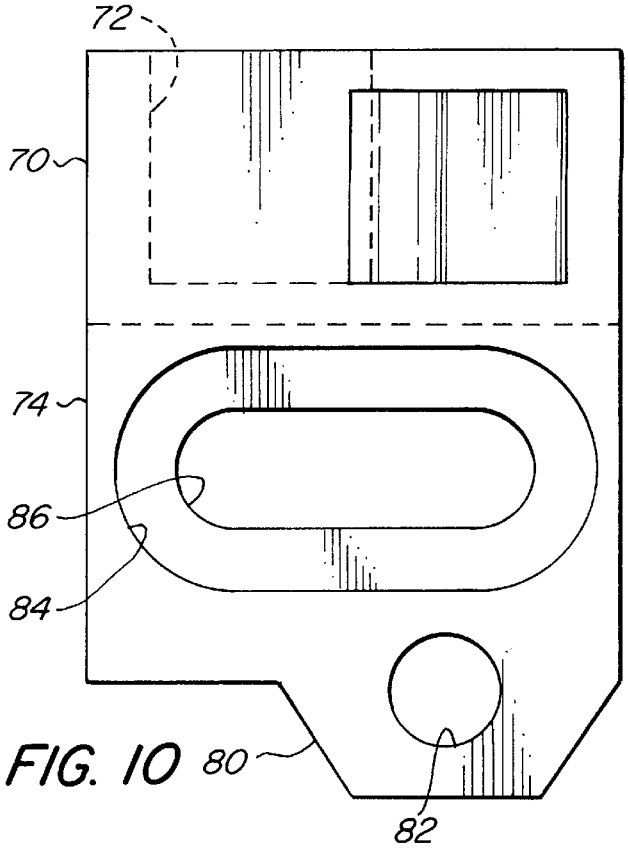
FIG. 10 is a front elevational view of the movable member drawn to an enlarged scale.
Figure 12:
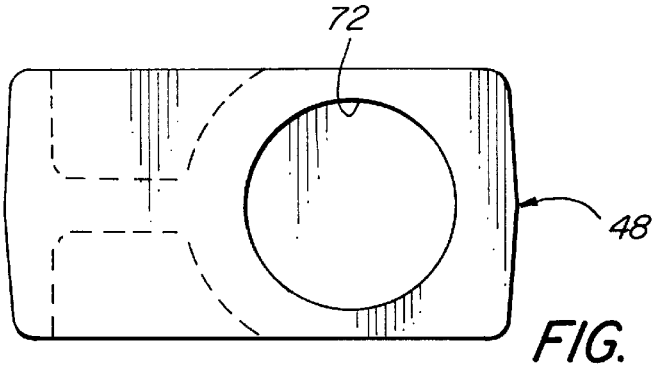
FIG. 12 is a bottom view thereof.
Figure 13:
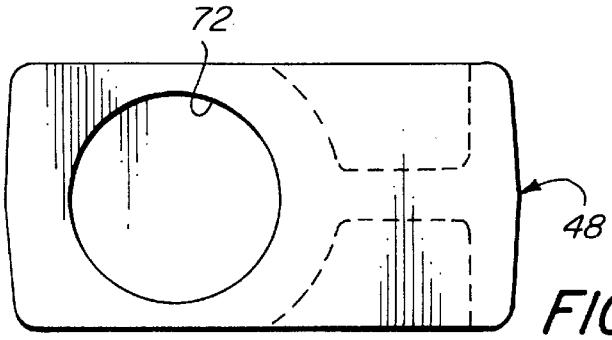
FIG. 13 is a bottom view of an oppositely handed movable member.

As seen in FIGS. 6–9, the base element 46 is molded with a recess 52 opening at the outer end thereof and in which is seated the movable element 48. Extending transversely along a portion of the inner end of the recess 52 is a toothed surface portion 54 above which is a planar shelf 53. A pair of horizontally extending ears 56 seat the vertical adjustment screw 58, and a hexagonal cavity 60 is molded in the opposite surface to seat a nut (not shown) which cooperates with a fastener 64 extending through the aperture 66 to secure the movable element 48 thereto in a horizontally adjusted position as will be described more fully hereinafter. Also molded in the opposite surface is a channel 68 in which the tab 40 of the bracket 14 seats to maintain the pivot insert 20 in assembly therewith while allowing vertical adjustment. As seen in FIG. 4, the head of the vertical adjustment screw 58 bears upon the end wall 34 of the bracket 14 about the aperture 38. The vertical adjustment screw 58 is a accessible to a screwdriver inserted through the aperture 38 as seen in FIG. 4.

Turning next to the movable element 48, it has an outer head portion 70 of greater thickness in the outer end of which is provided a cylindrical recess 72 in which is seated the pivot member 44. Extending from the head portion 70 is a slide portion 74 of lesser thickness than the head portion 70 and it has a transversely extending lip 76 at its inner end which seats in the transverse channel 55 of the base element 46. An ear 80 on the slide portion 74 extends over the toothed surface portion 54 and bears against the shelf 53 above the toothed portion 54. A circular aperture 82 is provided in the slide portion 74 having its axis offset from the toothed surface portion 54 for a purpose to be described more fully hereinafter. Also provided in the slide portion 74 is a transversely extending recess 84 and in which is located a transversely extending slot 86. The head of the fastener 64 seats in this recess 84 and its shank extends through the slot 86 into the aperture 66 of the base element 46.

Figure 14:
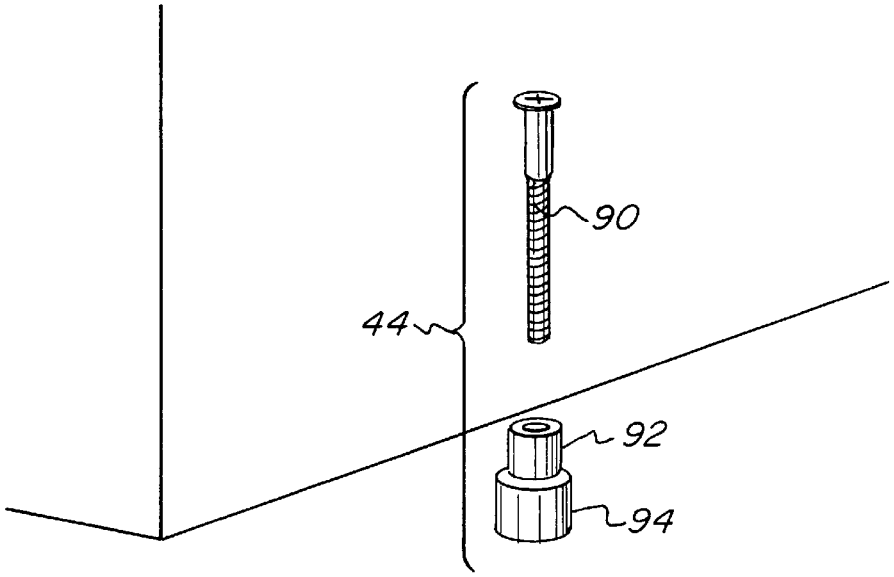
FIG. 14 is a perspective view of the disassembled bottom pivot member about to be installed in a typical installation.

As seen in FIG. 14, the pivot member 44 is comprised of the screw 90 and the bushing 92 which has a collar portion 94 of greater diameter. The head of the screw 90 bears against the bottom of the recess 72 and the collar portion 94 of the bushing 92 bears against the outer surface of the head portion 70 about the recess 72.

Figure 15:
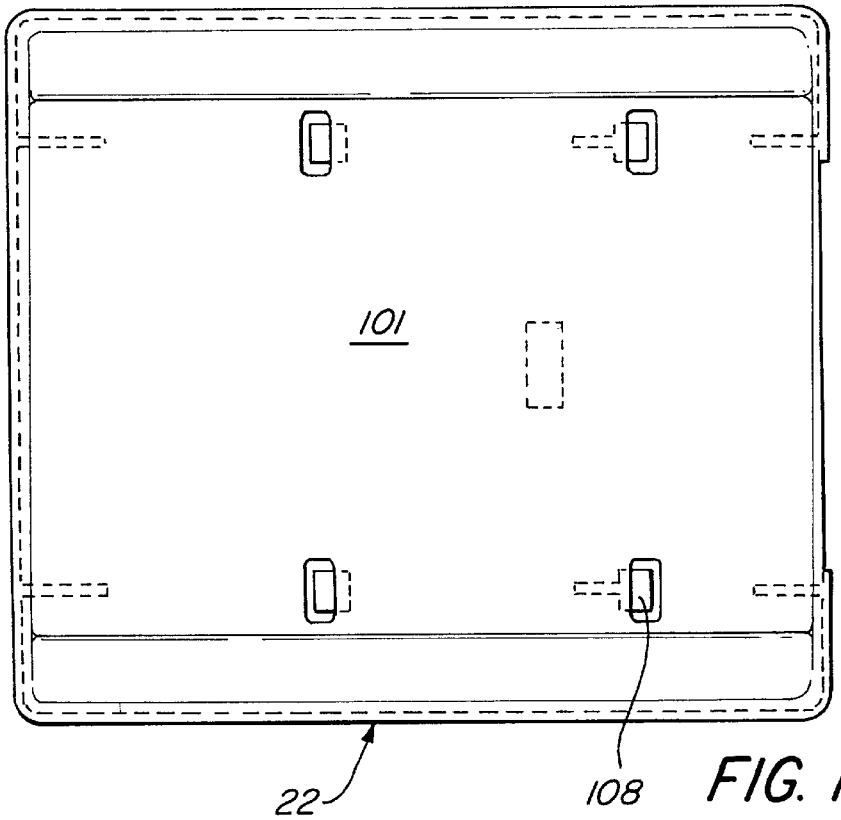
FIG. 15 is a elevational view of a cover drawn to an enlarged scale.
Figure 16:
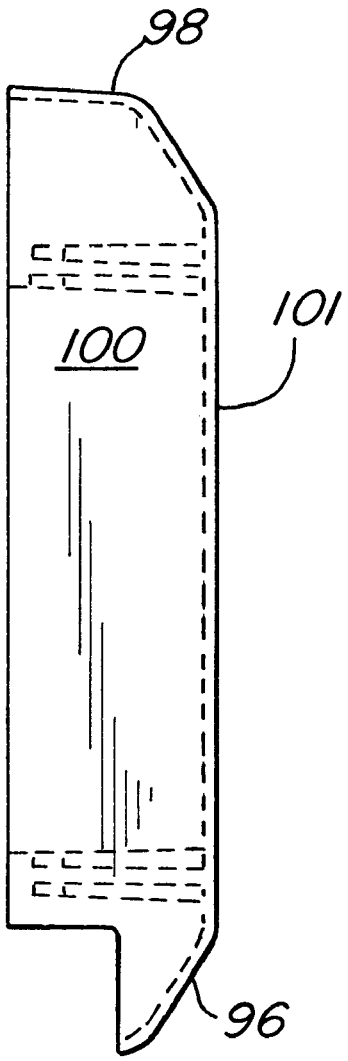
FIG. 16 is a top view thereof.
Figure 17:
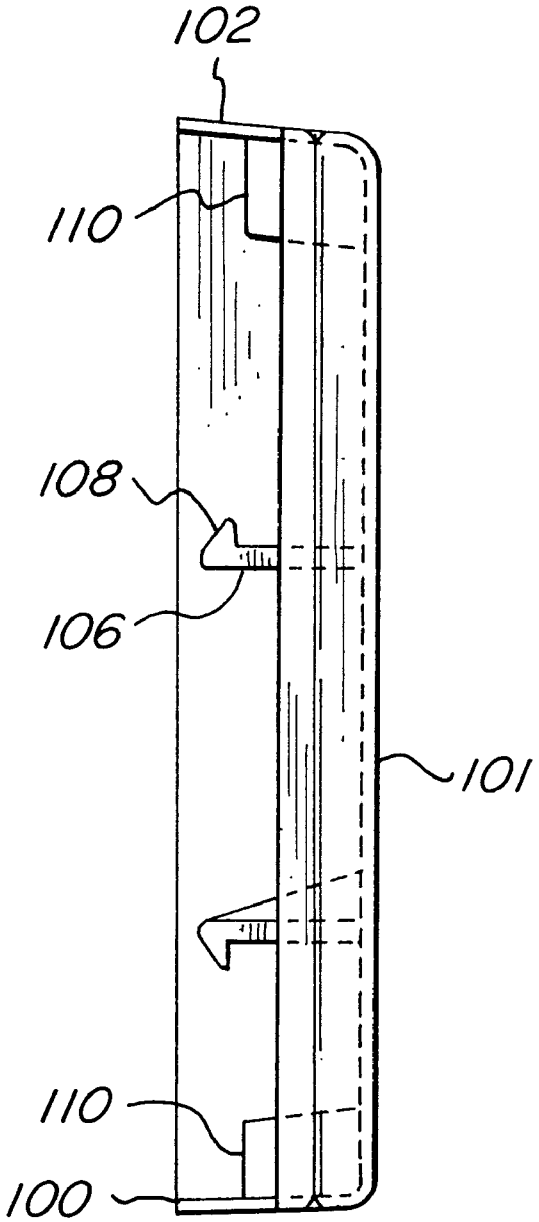
FIG. 17 is a side elevational view thereof.

Turning lastly to the cover 22, as seen in FIGS. 15 through 17, it is molded with a central wall panel 101, a resiliently deflectable side flange 96 along one side, a side wall 98 along the other side, an end wall 100 at one end, and end wall segments 102, 104 at the other end. Struts 110 stiffen the end wall 100 and end wall segments 102, 104. Four flexible fingers 106 extend perpendicularly to the inner surface of the wall panel 101 and have lips 108 on their free ends which resiliently snap behind the flanges 28, 30 on the bracket 14 to secure the cover in place. The pivot member 44 projects outwardly through the space between the end segments 102, 104. The covers 22 are provided in left handed and right handed sets so as to accommodate the different placement.

In assembling and mounting the door utilizing the bracket assemblies of the present invention, the metal brackets 14, are utilized at each corner to secure the stiles 10 and rails 12 in assembly with the door panel 16. The door as so assembled may be conveniently packaged and shipped.

At the site, the installer determines whether the door is to swing to the right or the left. This may require the selection of pivot blocks 42, or movable elements 48, so as to have the recess 72 oriented adjacent the pivot side of the door.

Initially, the pivot members 44 are removed from the bracket assemblies 18 and mounted into the header and the floor in vertical alignment by initially drilling holes and then placing the bushings 92 about the screws 90 and driving the screws 90 into the drilled holes.

The pivot inserts 20 are pushed into the open outer ends of the brackets 14 under the lips 32. As they are pushed inwardly, the tab 40 is deflected until the channel 68 in the base element 46 moves thereover, and the tab 40 springs thereinto to retain the block in assembly. The adjusting screw 58 in the upper assembly 18 is rotated by a screwdriver to move the base element 46 downwardly to the fullest extent possible. The adjusting screw 58 in the lower assembly 18 is rotated to move the base element 46 to a position about 10 mm from the end wall 34.

The door is then moved into the desired position and moved downwardly so that the bottom pivot member 44 seats in the recess 72 of the bottom movable element 48. The upper bracket assembly is moved to align the recess 72 with the pivot member 44 in the header and the adjusting screw 58 is rotated to seat the bushing 92 therein.

The adjusting screws 58 in both bracket assemblies 14 are then rotated to adjust the lower rail 12 of the door to a position about 9 mm from the floor and the collar 94 of the bushing 92 is adjacent the top rail 12.

The door can be moved to the right or the left by releasing the fastener 64, and inserting the screwdriver into the aperture 82 so that its flutes engaged the toothed surface portion 54. Rotation of the screwdriver will then 'walk' the shank and thereby move the movable element 46 therealong. After the adjusted position has been reached, the locking screw 64 is then tightened.

Finally, the covers 22 are placed over all of the bracket assemblies 18 by first engaging the fingers 106 along the deflectable side walls 96 with the flanges 28,30, and then pivoting the side walls 98 towards the brackets 14 to deflect the fingers 106 and engage the flanges 28, 30 on the other side of the brackets 14.

The brackets are conveniently stamped from sheet metal of about 0.030–0.050 inch thickness. The base element, movable element and bushing are desirably molded from a rugged, impact resistant polymer such as nylon, acetal, polycarbonate and polypropylene. The cover may be fabricated from any one of a number of resins affording desirable appearance and reasonable flexibility such as polypropylene, nylon, and acrylonitrile/butadine/styrene terpolymers. The fasteners are all desirably fabricated from metal.

As will be readily appreciated from the foregoing detailed drawings and description, the door may be preassembled without the pivot inserts so as to facilitate shipment and packaging, and, depending upon the installation, the appropriate pivot inserts can be selected for insertion thereinto at the job site. The process of mounting the door in an appropriate opening is relatively simple since the pivot members can be first mounted in the header and the floor in the desired position, the door moved into position, and then the bracket assemblies adjusted to fully seat the pivot members in the brackets. Not only can vertical adjustment be effected conveniently, but also horizontal adjustment can be effected to ensure that the door is true.

Having thus described the invention, what is claimed is:

1. A pivotable door assembly comprising:

a. a generally rectangular door having stiles and rails;

b. brackets coupling the ends of said stiles to the adjacent ends of said rails, said brackets each having side walls defining a channel therebetween extending parallel to said stiles and opening at one end thereof adjacent the periphery of the door; and c. a pivot insert seated in each of said brackets disposed on one side of said door, said pivot insert including a body member slidably seated in said channel and a pivot member rotatably seated in said body member and extending parallel to said channel and stiles and outwardly of said open one end of said bracket for engagement with the floor or ceiling, at least one of said pivot inserts including adjustable means seated in said body member and cooperating with said bracket for adjusting the position of said pivot insert along the length of said channel and thereby the length of said pivot member extending beyond said open one end of said bracket, said body member being comprised of a base element, a movable element mounted thereon and movable relative to said base element in a direction perpendicular to said side walls of said bracket, and means for adjustably positioning said movable element relative to said base element and thereby between said side walls of said bracket to effect adjustment thereof.

2. The pivotable door assembly in accordance with claim 1 wherein said positioning means includes a toothed surface portion on said base element extending perpendicularly to said bracket side walls, said toothed surface portion being engageable by a rotatable member disposed in said movable element to move said movable element along said toothed surface portion.

3. The pivotable door assembly in accordance with claim 2 wherein said movable element includes a flange portion extending longitudinally over said toothed surface portion, said flange portion having an aperture therein providing access to said toothed surface portion and into which a tool may be inserted to engage both said toothed surface portion and said flange so that rotation of the tool causes said movement of said movable element relative to said base element.

4. The pivotable door assembly in accordance with claim 1 wherein said body member includes releasable fastening means securing said movable element in an adjusted position.

5. The pivotable door assembly in accordance with claim 1 including interengaging means on said bracket and pivot insert for preventing unintended separation of said pivot insert from said bracket in which it is seated.

6. The pivotable door assembly in accordance with claim 1 including a cover extending over and disengageably mounted on said bracket.

7. The pivotable door assembly in accordance with claim 1 wherein said pivot member includes a threaded fastener with a head and a shank extending outwardly of said open one end of bracket, and a bushing extending about the shank adjacent said head, and wherein said body member has a recess in which said fastener and bushing are seated.

8. The pivotable door assembly in accordance with claim 7 wherein said bushing has an enlarged collar spaced from said head of said fastener and said collar bears upon said body member about said recess.

9. The pivotable door assembly in accordance with claim 7 wherein said head of said fastener rotatably seats upon the surface of said body member at the bottom of said recess.

10. The pivotable door assembly of claim 1 wherein said means for adjusting the position of said pivot insert along the length of said channel comprises a screw threadably seated in said body member and having a head bearing on said bracket, said screw being rotatable to displace said pivot insert along said bracket channel.

11. The pivotable door assembly in accordance with claim 10 wherein said bracket has an end wall against which said screw head bears, said end wall having an aperture of lesser dimension than said screw head for insertion therethrough of a tool to engage said head to effect rotation of said screw.

12. A pivot bracket assembly for assembling stiles and rails to form the periphery of a door:

a. a bracket for coupling the ends of the stiles to the adjacent ends of the rails, said brackets having side walls defining a channel therebetween extending parallel to the stiles and opening at one end thereof adjacent the periphery of the door frame;

b. a pivot insert seated in said bracket and including a body member slidably seated in said channel and a pivot member rotatably seated in said body member and extending parallel to said channel and outwardly of said open one end of said bracket for engagement with the floor or ceiling, said pivot insert including adjustable means seated in said body member and cooperating with said bracket for adjusting the position of said pivot insert along the length of said channel and thereby the length of said pivot member extending beyond said open one end of said bracket, said body member being comprised of a base element, a movable element mounted thereon and movable relative to said base element in a direction perpendicular to said side walls of said bracket, and means for adjustably positioning said movable element relative to said base element and thereby between said side walls of said bracket to effect adjustment thereof, said positioning means includes a toothed surface portion on said base element extending perpendicularly to said bracket side walls, said toothed surface portion being engageable by a rotatable member disposed in said movable element to move said movable element along said toothed surface portion.

13. The pivot bracket assembly in accordance with claim 12 wherein said movable element includes a flange portion extending longitudinally over said toothed surface portion, said flange portion having an aperture therein providing access to said toothed surface portion and into which a tool may be inserted to engage both said toothed surface portion and said flange so that rotation of the tool causes said movement of said movable element relative to said base element.

14. The pivot bracket assembly in accordance with claim 12 wherein said body member includes releasable fastening means securing said movable element in an adjusted position.

15. The pivot bracket assembly in accordance with claim 12 including interengaging means on said bracket and pivot insert for preventing unintended separation of said pivot insert from said bracket in which it is seated.

16. The pivot bracket assembly in accordance with claim 12 including a cover extending over and disengageably mounted on said bracket.

17. The pivot bracket assembly of claim 12 wherein said means for adjusting the position of said pivot insert along the length of said channel comprises a screw threadably seated in said body member and having a head bearing on said bracket, said screw being rotatable to displace said pivot insert along said bracket channel.

18. The pivot bracket assembly in accordance with claim 17 wherein said bracket has an end wall against which said screw head bears, said end wall having an aperture of lesser dimension than said screw head for insertion therethrough of a tool to engage said head to effect rotation of said screw.

19. A pivot bracket assembly for assembling stiles and rails to form the periphery of a door:

(a) a bracket for coupling the ends of the stiles to the adjacent ends of the rails, said brackets having side walls defining a channel extending therebetween parallel to the stiles and opening at one end adjacent the periphery of the door;

(b) a pivot insert seated in said bracket and including a body member slidably seated in said channel and a pivot member rotatably seated in said body member and extending parallel to said channel and outwardly of said open one end of said bracket for engagement with the floor or ceiling, said pivot insert including adjustable means seated in said body member and cooperating with said bracket for adjusting the position of said pivot insert along the length of said channel and thereby the length of said pivot member extending beyond said open one end of said bracket; said pivot member including a threaded fastener with a head and a shank extending outwardly of said open one end of said bracket, and a bushing extending about the shank adjacent said head, and said body member having a recess in which said fastener and bushing are seated.

20. The pivot bracket assembly in accordance with claim 19 wherein said bushing has an enlarged collar spaced from said head of said fastener and said collar bears upon said body member about said recess.

21. The pivot bracket assembly in accordance with claim 19 wherein said head of said fastener rotatably seats upon the surface of said body member at the bottom of said recess.

* * * * *